United States Patent [19]

Ferguson

[11] 4,127,281

[45] Nov. 28, 1978

[54] BOAT ROLLER

[76] Inventor: Roy A. Ferguson, 40 School St., Suncook, N.H. 03275

[21] Appl. No.: 828,276

[22] Filed: Aug. 29, 1977

[51] Int. Cl.[2] ..... B63C 13/00

[52] U.S. Cl. ..... 280/47.13 B; 9/1.2

[58] Field of Search ..... 280/414 A, 47.13 B, 280/47.32; 9/1.2; 16/29, 30

[56] References Cited

U.S. PATENT DOCUMENTS

| | | | |
|---|---|---|---|
| 1,693,700 | 12/1928 | McCall | 280/47.32 |
| 3,134,111 | 5/1964 | Atwood | 9/1.2 |
| 3,333,861 | 8/1967 | Hoffman | 9/1.2 X |
| 3,361,441 | 1/1968 | McRae | 280/47.32 |
| 3,462,781 | 8/1969 | Olvera | 9/1.2 |
| 3,499,177 | 3/1970 | Wolfe | 9/1.2 |
| 3,616,474 | 11/1971 | Lindblad | 9/1.2 |
| 3,697,096 | 10/1972 | Hadley | 280/47.32 |
| 3,857,128 | 12/1974 | Gilster | 9/1.2 |
| 4,036,507 | 7/1977 | Henderson | 280/414 A |

*Primary Examiner*—Joseph F. Peters, Jr.
*Assistant Examiner*—R. Schrecengost
*Attorney, Agent, or Firm*—Norman S. Blodgett; Gerry A. Blodgett

[57] ABSTRACT

Boat attachment having a main body permanently attached to one end of the boat, having a bracket removably mounted on the main body which carries an elongated cylindrical roller, and having means to hold the bracket on the main body.

5 Claims, 3 Drawing Figures

FIG. 1
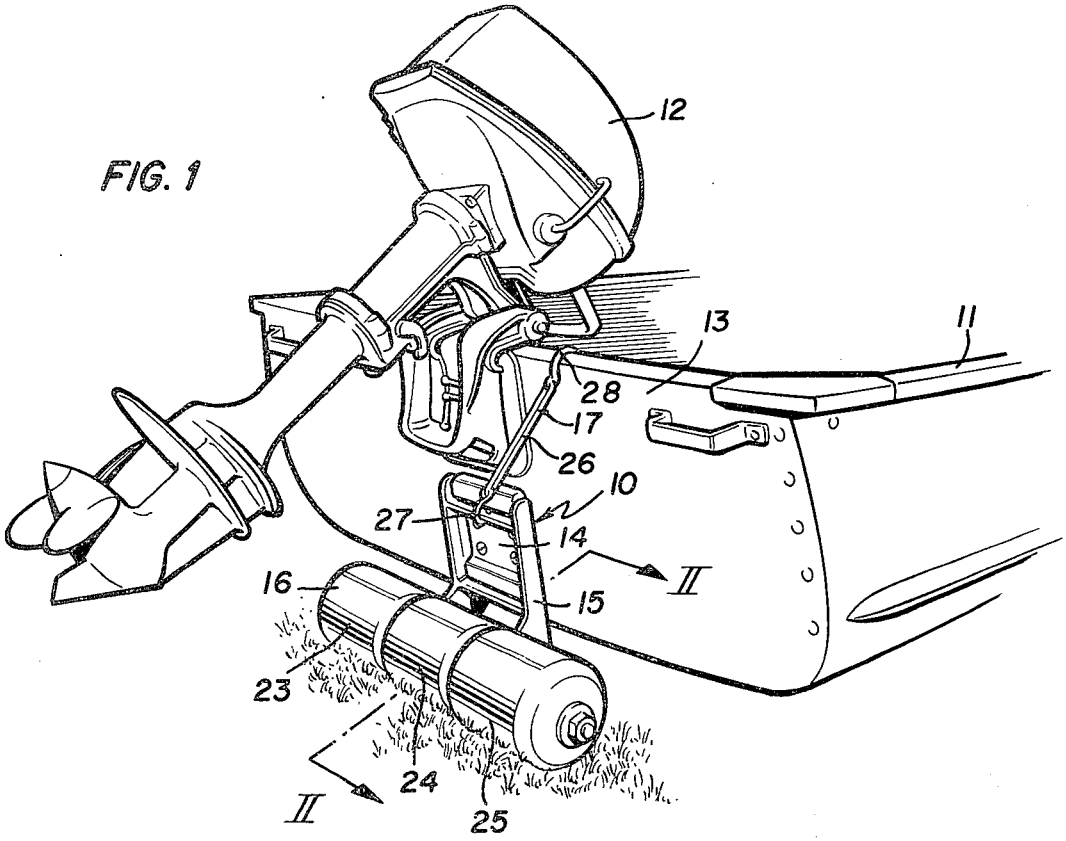
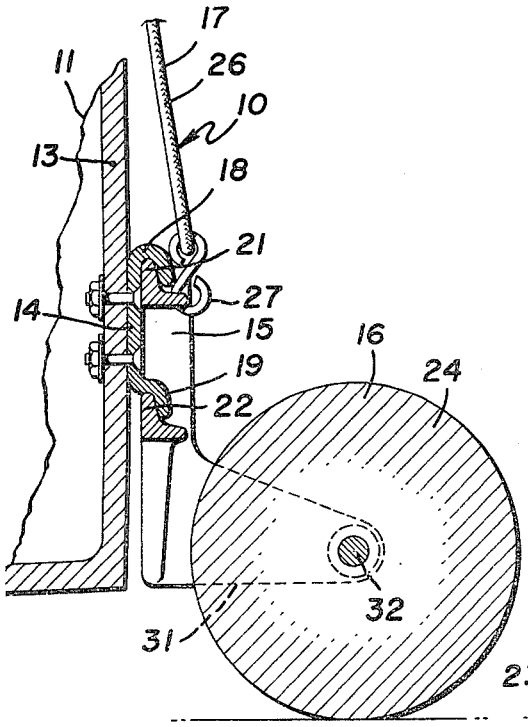
FIG. 2
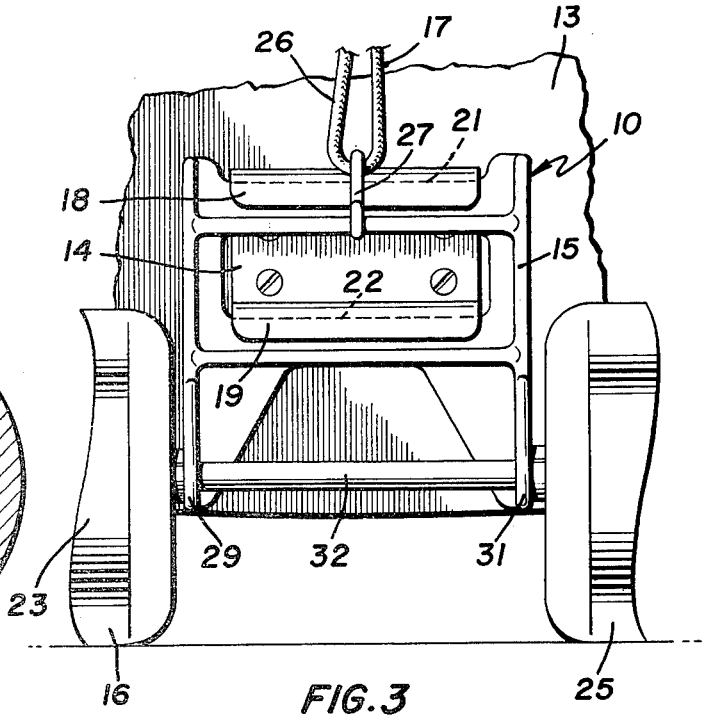
FIG. 3

BOAT ROLLER

BACKGROUND OF THE INVENTION

In the design and operation of small boats, the problem exists that many small boats are too heavy to carry and it is difficult for a single person to maneuver his boat into the water. Furthermore, even when two people are present, dragging the boat across rocks and sand causes the bottom to wear and the paint to be removed. The wear on the wood as the years go by can be appreciable and can cause destruction of the boat eventually. Even losing the bottom paint from a boat will cause fouling by various marine organisms when the boat is in the water. Quite often a small dingy is dragged up the sand so as to be above high tide in the ocean; at low tide it is a long distance to drag the boat to get it above the high tide line in order that the boat cannot float away when high tide eventually arrives. It has been suggested in the past that the boat be provided with wheels, but mechanisms of this kind make the boat difficult to maneuver in the water and are an added source of maintenance. The wheels in such prior art design tend to sink into the sand and become caught between boulders, so that it is difficult to tow the boat to the water. Furthermore, if the boat could be readily maneuvered by a single person, it is possible to use the boat as a sort of wheelbarrow to carry other equipment such as gas tanks, engines, and the like down to the water at the same time. In addition, the prior art devices have been fairly intricate and these are easily rendered inoperative in the sandy, salt water environment of the ocean. These and other difficulties experienced with the prior art devices have been obviated in a novel manner by the present invention.

It is, therefore, an outstanding object of the invention to provide a simple means of rendering a small boar maneuverable over a substantial distance by a single person.

Another object of this invention is the provision of a boat attachment which can be applied to the end of a small boat which will allow the boat to be moved around despite the presence of boulders and/or soft sand.

A further object of the present invention is the provision of a boat attachment which is simple in construction, which is easy to manufacture, and which is capable of a long life of useful service with a minimum of maintenance.

It is another object of the instant invention to provide a boat attachment consisting of an elongated roller formed of an elastomer plastic which is not only light in weight, but actually provided floatation under certain circumstances.

A still further object of the invention is the provision of a boat attachment which, when removed from the boat, leaves remaining only a very small permanent fixture that will not interfere in any way with the operation of the boat, including the operation of an outboard motor.

With these and other objects in view, as will be apparent to those skilled in the art, the invention resides in the combination of parts set forth in the specification and covered by the claims appended hereto.

SUMMARY OF THE INVENTION

In general, the invention consists of a boat attachment, having a main body which is adapted to be permanently attached to one end of the boat, having a bracket removably connected to the body, having an elongated roller rotatably mounted on the bracket, and having the means for releasably holding the bracket on the body.

More specifically, the main body and the bracket have, as part of their structures, upper and lower flanges which interengage to lock the main body and the bracket together on the boat. The means for releasably holding the bracket on the body consists of a stretchable cord fastened on one end to the bracket and having at the other end a hook which engages the upper edge of the transom of the boat. The roller consists of a plurality of elongated cylinders formed of floatable material which, in the preferred embodiment, consists of foamed polyurethane. The bracket is provided with two spaced, parallel, rearwardly-directed feet having an axle extending through their outer ends. One roller cylinder is mounted on the axle between the feet and one roller cylinder is mounted on each end of the axle as it extends outwardly of its respective foot.

DESCRIPTION OF THE DRAWINGS

The character of the invention, however, may be best understood by reference to one of its structural forms, as illustrated by the accompanying drawings, in which:

FIG. 1 is a perspective view of a boat attachment embodying the principles of the present invention shown in use with a small boat, FIG. 2 is a vertical sectional view of the invention taken on the line II—II of FIG. 1, and FIG. 3 is a rear elevational view of the invention with a portion removed for clarity of presentation.

DESCRIPTION OF THE PREFERRED EMBODIMENT

Referring first to FIG. 1, wherein are best shown the general features of the invention, the boat attachment, indicated generally by the reference numeral 10, is shown in use with a boat 11, having a transom 13 at one end on which may be mounted an outboard motor 12.

The details of the boat attachment are particularly well shown in FIGS. 2 and 3, in which it can be seen that the boat attachment 10 is provided with a main body 14 which is permanently fastened to the transom 13 of the boat by nuts and bolts. A bracket 15 is removably connected to the body 14 and carries an elongated roller 16. A means 17 is provided for releasably holding the bracket 15 on the body 14.

The main body 14 has, as part of its structure, an upper flange 18 and a lower flange 19 which are directed downwardly and which are spaced and parallel. The bracket 15 also has flanges 21 and 22 which are directed upwardly and which are spaced and parallel. When the bracket 15 is in place cooperating with the main body 14, the upper flange 21 of the bracket 15 extends up under the upper bracket 18 of the body 14. Similarly, the lower flange 22 of the bracket 15 fits up under the lower flange 19 of the body 14.

As is best evident in FIG. 1, the roller 16 consists of three elongated cylinders 23, 24, and 25 which are formed of foamed polyurethane having a density less than water, so that the bracket 15 and the roller are floatable. The means 17 for maintaining the bracket 15 in place on the main body 14 consists of a stretchable cord 26 of the type known as "shock" cord. The cord 26 is provided with an S-shaped clip 27 at one end which engages a hole in the bracket 15 and a hook 28 (see FIG. 1) which engages the top edge of the transom 13 of the boat and places the cord 26 under tension.

In the preferred embodiment, each of the cylinders 23, 24, and 25 has a diameter which is approximately one-third of the length of the entire roller and the length of the entire assemblage, i.e., the roller 16, is approximately one and one-half feet.

As is evident in FIGS. 2 and 3, the bracket 15 is provided with two spaced, parallel, rearwardly-directed feet 29 and 31 which have an axle 32 extending through their outer ends. The roller cylinder 24 is mounted on the axle 32 between the feet 29 and 31 (it has been removed from FIG. 3 of the drawings for clarity of presentation). The roller cylinder 23 is mounted to the left side of the foot 29 on the axle 32, while the roller cylinder 25 is mounted on the right-hand end of the axle as it extends beyond the foot 31. The cylinders 23 and 25 are maintained in place on the axle by the use of suitable washers and nuts threaded on the ends of the axle. The ends of the roller cylinders 23, 24, and 25 are suitably provided with smooth bevels. The bracket 15, as is best evident in FIG. 3, has a generally ladder-like configuration with two side elements terminating in the feet 29 and 31; the flanges 21 and 22 act as cross-pieces in the ladder. The structure, therefore, has considerable strength and rigidity because of the nature of this construction. In the preferred embodiment, the main body 14 and the bracket 15 will be cast from aluminum to make them easier to handle and to make them resistant to rust.

The operation of the invention and advantages of the invention will now be readily understood in view of the above description. The main body 14 is permanently attached to the boat 11, so that it always resides with it, irrespective of the use to which the boat is being put. Naturally, when the boat isn't being used and is drawn up on the shore, the main body 14 does not present a problem in any way. Furthermore, when it is in use with the outboard motor 12, it still presents no interference with the use of the motor. When the boat is to be moved from one place to another (as from the upper part of the beach down to the water), the bracket 15 is mounted in place. The flanges 21 and 22 are moved upwardly under the flanges 18 and 19, respectively, on the main body and the cord 26 is pulled upwardly until the hook 28 engages the upper edge of the transom 13. At that time the shock cord 26 is under considerable spring tension. Once the bracket is in place and is held firmly by the shock cord, so that the flanges 21 and 22 do not jump out of the trap in which they are engaged with the flanges 18 and 19, the apparatus is now ready for use. In most cases, the user will lift the front end of the boat and move it around like a wheelbarrow with the roller 16 engaging the ground and providing for smooth passage. Because the roller 16 is formed of a resilient material and because of the wide surface contact with the ground, it will not sink into the ground if the ground area is soft sand. Even if the area being moved over is rock or some irregular material of that nature, the characteristic of the roller is such as to compensate for the irregularities. The boat can, therefore, be moved around fairly easily. The fact that the roller 16 is quite long means that the boat will not tip when being moved around this way. If either of the roller cylinders 23, 24, and 25 become damaged in use, it is a simple matter to remove the nuts from the end of the axle 32, remove the axle and replace whichever one of the roller cylinders has been damaged.

It can be seen, therefore, that the present invention has a number of decided advantages over the prior art. To begin with, the simplicity of the construction assures that there are no small parts to become damaged and no areas in which sand or mud can accumulate that would inhibit the operation of the device. Even a small amount of material becomes imbedded under the flanges it is easily wiped out and, of course, the movement of the boat into the water causes the whole apparatus to be cleansed in any case. The present invention, of course, assures less lifting on the part of the boat operator, the equipment is inexpensive to own and is convenient and easy to install. Also, it can be removed readily and works in all kinds of ground from beach to pavement. It should be noted that, under certain state laws, it is necessary to carry floatation equipment in each small boat, one piece of floatation equipment for each occupant. It should be realized, with the present device being made of floatable material, the bracket and the rollers may constitute such a piece of floatation equipment to satisfy the law. The bracket with the roller may be installed and removed while it is in the water. When approaching a beach, it is easy to install the bracket while still floating and then to row up to the beach and simple pull the boat up without ever dragging the boat bottom across the sand and rocks. Furthermore, if desired, the equipment may be left installed while rowing, since it does not add appreciable drag at rowing speeds. In addition, it may be used with a small outboard motor installed to the left side of the stern in the tilted up position and may be used as a wheelbarrow in carrying other equipment in the boat during launching operations to save trips up and down the beach. In addition, since the outboard motor 12 can in many instances be quite heavy, the use of the present equipment saves first dragging the boat down to the water and then carrying the outboard motor. It should be noted that one distinct advantage of the present invention is that it is not necessary to turn the boat over in order to move it along the ground, it can stay in its ordinary, upright position and, therefore, can hold all of the boating equipment that one wishes to move from one place to another along with the boat.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Boat attachment comprising:

(a) a main body adapted to be permanently attached to one end of the boat, the main bodying having an upper flange extending downwardly, and a lower flange extending downwardly, (b) a bracket having an upper flange extending upwardly to engage beneath the main body upper flange, and a lower flange extending upwardly to engage beneath the main body lower flange, (c) roller means rotatably mounted on the bracket, and (d) a stretchable cord having a clip at one end for attachment to the bracket and a hook at the othe end for engagement with the transom of the boat for releasably holding the bracket flanges in engagement with the corresponding main body flanges.

2. Boat attachment as recited in claim 1, wherein the roller means of at least one elongated cylinder of floatable material.

3. Boat attachment as recited in claim 1, wherein the roller means consists of an elongated cylinder of foamed elastomer whose diameter is approximately one-third the length.

4. Boat attachment as recited in claim 3, wherein the elastomer is polyurethane and the length is approximately one and one-half feet.

5. Boat attachment as recited in claim 1, wherein the bracket is provided with two spaced, parallel, rearwardly-directed feet having an axle extending through their outer ends, the roller means comprising one roller cylinder being mounted on the axle between the feet, and one roller cylinder mounted on each end of the axle as it extends outwardly of its respective foot.

* * * * *